US006511002B1

(12) United States Patent
DeLuca

(10) Patent No.: US 6,511,002 B1
(45) Date of Patent: Jan. 28, 2003

(54) EMD-TYPE INJECTOR WITH IMPROVED SPRING SEAT

(75) Inventor: Frank DeLuca, Enfield, CT (US)

(73) Assignee: Alfred J. Buescher, Cleveland, OH (US)

( * ) Notice: Subject to any disclaimer, the term of this patent is extended or adjusted under 35 U.S.C. 154(b) by 0 days.

(21) Appl. No.: 10/171,052

(22) Filed: Jun. 13, 2002

(51) Int. Cl.[7] ..... F02M 63/00; F02M 61/00

(52) U.S. Cl. ..... 239/533.3; 239/88; 239/533.2; 239/533.9; 239/533.11; 239/533.15

(58) Field of Search ..... 239/88, 533.1, 239/533.2, 533.3, 533.4, 533.5, 533.6, 533.7, 533.8, 533.9, 533.11, 533.12, 533.13, 533.14, 533.15

(56) References Cited

U.S. PATENT DOCUMENTS 3,006,556 A * 10/1961 Shade et al. ..... 239/533.7
3,469,793 A * 9/1969 Guertler ..... 239/533.8
4,758,169 A 7/1988 Steiger ..... 239/96
4,911,366 A 3/1990 Preisner ..... 239/533.3
5,056,488 A 10/1991 Eckert ..... 123/446
5,191,867 A 3/1993 Glassey ..... 123/446
5,467,924 A 11/1995 Buescher et al. ..... 239/88
5,597,118 A 1/1997 Carter, Jr. et al. ..... 239/92
5,647,540 A * 7/1997 Buckley ..... 239/533.2
5,697,342 A 12/1997 Anderson et al. ..... 123/446
5,915,624 A 6/1999 Coldren et al. ..... 239/96
5,967,413 A 10/1999 Tian ..... 239/88
6,007,000 A * 12/1999 DeLuca ..... 239/533.3
6,029,902 A 2/2000 Hickey et al. ..... 239/88
6,196,472 B1 3/2001 Cooke ..... 239/88
6,283,390 B1 9/2001 Brendle et al. ..... 239/533.2

* cited by examiner

*Primary Examiner*—Robin O. Evans
(74) *Attorney, Agent, or Firm*—Pearne & Gordon LLP

(57) ABSTRACT

An EMD-type injector is provided with a spring seat in which the juncture between the head and the stem of the spring seat is formed as an undercut groove within specified shape parameters.

4 Claims, 1 Drawing Sheet

EMD-TYPE INJECTOR WITH IMPROVED SPRING SEAT

FIELD OF THE INVENTION

This invention relates to fuel injection nozzles used in diesel engines, and particularly to injection nozzles that are used in mechanical injectors of the type known as EMD injectors, originally manufactured by Diesel Equipment Division of General Motors for Electro Motive Division of General Motors. As used herein, "EMD-type injectors" refer to mechanically operated devices, as distinguished from solenoid-operated devices (also made by the same manufacturer).

BACKGROUND OF THE INVENTION

EMD-Type Injectors.

EMD-type injectors include a nozzle body which houses a nozzle valve and terminates in a nozzle tip. The seat for the nozzle valve is formed at or near the nozzle tip. When the valve is open (when its distal end is raised from the valve seat) incoming pressurized fuel flows to a small feed chamber or "sac," located just below the seat and within the tip, and is distributed by the sac to spray holes formed in the wall of the nozzle tip. The spray holes lead into the engine chamber where the fuel is atomized.

The nozzle valve is biased to closed position by a valve spring. This spring is of the coil-spring type and is contained within a spring cage having a spring chamber of generally cylindrical shape. The spring cage is stacked just above (upstream of) the nozzle body. The diameter of the spring chamber (the inside diameter of the spring cage) is only slightly larger than the outside diameter of the spring, such that the spring fits snugly within the spring chamber, but with sufficient clearance to allow the spring to freely compress and expand therein as the nozzle valve opens and closes. The spring force is transmitted axially through the stem portion of the nozzle valve to bias the nozzle valve to seated, closed position until the bias of the spring is overcome by pressure of incoming fuel acting on a conical differential area of the nozzle valve. This latter action forces the nozzle valve in the opening direction against the bias of the spring.

A disc type check valve for preventing reverse flow of the fuel is contained in a check valve cage stacked just above (upstream of) the spring cage. Additional elements are stacked still further upstream, including the bushing of a plunger-and-bushing assembly for pressurizing the diesel fuel during each injection cycle.

The nozzle body, spring cage, check valve cage and other elements are stacked one above the other within a housing nut. The housing nut is itself threadedly connected on a boss on an assembly block, and when this threaded connection is tightened down, the stacked elements are firmly secured in their stacked relationship.

Spring Seats in EMD-Type Injectors.

A particular characteristic of an EMD-type injector is the design of the spring seat. This element couples the spring to an extension of the nozzle valve, thereby accomplishing the transmission of compressive forces between the spring and the nozzle valve. The spring seat has a cylindrical spring seat stem which is surrounded by and relatively snugly received within the lower end of the coil spring, but again with sufficient clearance to allow the spring to freely compress and expand along the stem as the nozzle valve opens and closes. The spring seat also has an annular head that is coaxial with the spring seat stem. The head is foreshortened, being axially shorter than it is wide, so that the overall shape of the spring seat is similar to a mushroom with its stem and head, but inverted so the head is below-the stem, i.e., with respect to the position and orientation of the spring seat in the overall nozzle valve assembly, the foreshortened head forms the distal end of the spring seat and the stem forms the proximal end.

The spring seat has an annular flat face formed on the proximal side of its head against which the lower or distal end of the coil spring bears. This face also may be referred to as the spring-receiving face. The end of the coil spring is ground to provide area contact between the spring and the flat face around a substantial annular extent of the flat face, and preferably around a majority of said annular extent. The spring-receiving or flat face is perpendicular to the sidewall of the spring seat stem and meets it at a first annular juncture. The coil spring is unrestricted against creeping in a rotating motion around its central axis as it compresses and expands.

A central head recess extends axially within the annular head and coaxially therewith to a depth which is a considerable portion of the total thickness of the head at is thickest point (the total thickness being the axial distance from the distal end to the plane of the annular flat face). This recess has an annular sidewall and terminates in a circular end wall perpendicular to the sidewall and meeting the sidewall at what may be referred to as a second annular juncture.

The central head recess receives the above-mentioned extension of the nozzle valve. Any and all compressive or thrusting forces between the spring and the nozzle valve are transmitted via a thrusting action imposed on the nozzle valve extension in the up or down direction; all such forces are transmitted across the interface between the circular tip of the nozzle valve extension and the circular end wall of the head recess; and all such forces are transmitted between the spring and the end wall of the head recess through the body of the spring seat. The compressive or thrusting forces between the spring and the nozzle valve generate bending stresses in a bending stress zone in the body of the spring seat.

Significantly, in the just-described spring seat design, which is characteristic of EMD-type injectors, the least thick cross-section of metal in the bending stress zone, when the spring seat is viewed in cross-section taken through its central axis, is the relatively small thickness of metal extending between the above mentioned first and second annular junctures.

Such small thickness of metal is accordingly the locus of the greatest bending stresses. The portion of the spring seat head that is below or distal to the second annular juncture carries substantially no bending stresses, since that portion of the spring seat head is not tied to the nozzle valve extension, and is bypassed, so to speak, by the thrusting action of the nozzle valve extension.

Spring Seats in EMD-Type Injectors Compared with Spring-Contacting Elements of Certain Other Injector Devices.

Accordingly, the bending stress zone and bending-stress-carrying cross-section of the spring seat of an EMD-type injector extends only a small distance below the flat face or spring-receiving face of the spring seat, a distance substantially less than the wire diameter of the coil spring. This is to be contrasted with other injector devices in which the bending stress zone below the spring-receiving annular face of a stemmed, thrust-transmitting element extends more deeply below the spring-receiving face, so that a deeper cross section is available to carry bending stresses. Examples of such other injector devices are seen in U.S. Pat. No. 5,697,342 (poppet valve 86, needle valve 320); U.S. Pat.

No. 5,597,118 (poppet 44); U.S. Pat. No. 5,191,867 (poppet valve 38); U.S. Pat. No. 4,758,169 (loading piston 24, central bolt 34); U.S. Pat. No. 5,056,488 (intermediate piston 5); U.S. Pat. No. 6,196,472 (spring abutment member 52,): U.S. Pat. No. 5,967,413 (spool piece 125, poppet valve 220, spool piece 325); and U.S. Pat. No. 6,029,902 (spring keeper 62).

In addition to depth of cross-section, another factor in the design of the spring seat is stress concentration at the metal surface at the inside corner formed by the intersection between the stem of the spring seat and the spring-receiving flat face of the spring seat. High surface stresses at this point can cause hairline faults, which then propagate to deeper points in the metal, leading to mechanical failure of the part. For EMD-type injectors, conventional practice has been to simply fillet this inside corner with a small radius, thereby reducing local stress concentration from what it would be at a sharply defined intersection, while at the same time avoiding any undercutting into the stem and consequent reduction of the already-small juncture-to-juncture distance referred to above. Spring seats of this design for EMD-type injectors have long operated successfully and with only occasional failures.

For many other injector devices, including those disclosed in the patents cited above, in which the bending-stress zone below the spring-receiving annular face of a thrust-transmitting element extends more deeply below the spring-receiving face, avoidance of undercutting into the stem of the element has not been perceived as necessary, and in those devices, undercutting has been employed to provide curved-wall grooves in the stem instead of using filleting.

According to the present invention, undercutting may be removed as a concern for EMD-type injectors, and undercutting rather than filleting may be employed between the stem and spring-receiving flat face of the spring seat of EMD-type injectors, provided the groove formed by the undercutting is properly shaped. Providing an EMD-type injector spring seat with an undercut groove of proper shape reduces the rate of mechanical failure as compared with a conventionally filleted EMD-type injector spring seat even though the presence of such groove slightly reduces the juncture-to-juncture distance referred to above.

DETAILED DESCRIPTION OF THE INVENTION

Figure 1:
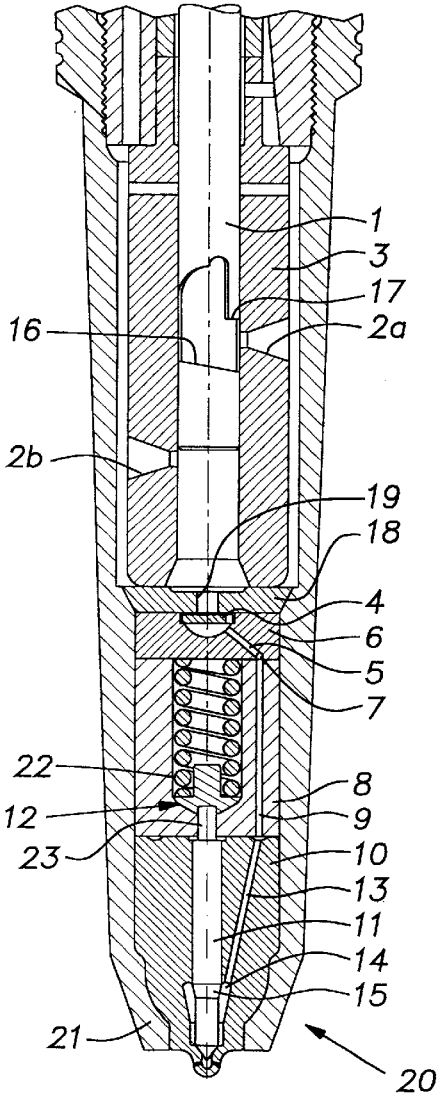
FIG. 1 PRIOR ART
FIG. 1 is a fragmentary cross-sectional view of a typical EMD-type injector of the prior art, with the top portions broken away and not shown.

In order that the invention may be most clearly understood, a conventional diesel locomotive EMD-type fuel injector will first be described in some detail. Such an injector is shown in cross-section in FIG. 1 and is generally indicated by the reference numeral 20.

The housing-nut 21 of the illustrated injector is threaded to and is an extension of the main housing (not shown) for the pump-injection unit. The nut 21 extends from the main housing, which is at the exterior of the engine, through the engine wall to the combustion chamber, and is clamped in the engine wall in a well known manner. The housing-nut houses the stacked main injector components described below, and threadedly clamps them in their stacked relationship in a well known manner.

EMD-type nozzles have a valve with differentially sized guide and seat so that there is a fixed relationship between the valve opening pressure and the valve closing pressure. During operation, when the helix edge 17 of the descending plunger 1 covers the fill port 2*a* in the bushing 3, a pressure wave is generated which travels past the check valve 4 and through the fuel ducts 5 in the check valve cage 6, through the annulus 7, fuel ducts 9 in the spring cage 8, into the illustrated connecting top annulus and the fuel ducts 13 of the nozzle body 10, and into the cavity 14 where the pressure wave acts on the conical differential area 15 of the nozzle valve 11 to lift the valve off the body seat against the bias of the coil spring 22, also referred to as the valve spring, and injection begins.

The valve stays lifted during the time fuel is being delivered by the plunger 1 to the nozzle 10. When the plunger helix edge 16 uncovers the spill port 2*b* in the bushing 3, the pressure above the plunger drops to fuel supply pressure and the check valve 4 in the valve cage 6 seats on the plate 18, sealing the fuel transport duct 19. As these events occur, the pressure in the nozzle fuel chamber 14 then drops rapidly; when it drops to the valve closing pressure, the valve closes and injection ends for that stroke of the plunger 1.

In a well known manner, the angular position of the plunger 1 is changed by a control rack (not shown) to control the amount of fuel delivered with each stroke of the plunger 1 by varying the positions in the stroke at which the fill and spill ports 2*a* and 2*b* are closed and opened.

As mentioned above, a particular characteristic of an EMD-type injector is the design of the spring seat, which is the element that couples the valve spring 22 to an extension 23 of the nozzle valve 11, thereby accomplishing the transmission of compressive forces between the spring and the nozzle valve. The spring seat has cylindrical spring seat stem 24 which is surrounded by and relatively snugly received within the lower end of the coil spring, with sufficient clearance to allow the spring to freely compress and expand along the stem as the nozzle valve opens and closes. The spring seat also has an annular head 25 that is coaxial with the stem 24. The head 25 (FIG. 2A) is foreshortened, being shorter in the axial direction than its width in the transverse direction, so that the overall shape of the spring seat is similar to that of a mushroom, with a stem and head, but inverted so the head is below the stem, i.e., with respect to the position and orientation of the spring seat in the overall nozzle valve assembly, the foreshortened head forms the distal end of the spring seat and the stem forms the proximal end.

The spring seat 12 has an annular flat face 26 formed on the proximal side of its head against which the lower or distal end of the coil spring 22 bears. This face 26 may also be referred to as the spring-receiving face. The end of the coil spring is ground flat to provide area contact between the spring and the flat face around a substantial annular extent of the flat face. The face 26 is perpendicular to the sidewall of the spring seat stem 24 and meets it at a first annular juncture 27. The coil spring is unrestricted against creeping in a rotating motion around its central axis as it compresses and expands. Such creeping tends to more evenly spread the wear that is caused by contact between the flat-ground spring end and the flat face 26.

A central head recess 28 extends axially within the annular head and coaxially therewith to a depth that is a considerable portion of the total thickness of the head at its thickest point (the total thickness being the axial distance from the distal end to the plane of the annular flat face). This recess 28 has an annular sidewall and terminates in a circular end wall perpendicular to the sidewall and meeting the sidewall at what may be referred to as a second annular juncture 29.

The central head recess 28 receives the above-mentioned extension 23 of the nozzle valve 11. Any and all compressive or thrusting forces between the spring 22 and the nozzle valve 11 are transmitted via a thrusting action imposed on the nozzle valve extension 23 in the up or down direction; all such forces are transmitted across the interface between the circular tip of the nozzle valve extension 23 and the circular end wall of the head recess 28; and all such forces are transmitted between the spring 22 and the end wall of the head recess 28 through the body of the spring seat 12. The compressive or thrusting forces between the spring 22 and the nozzle valve 11 generate bending stresses in a bending stress zone in the body of the spring seat 12.

Significantly, in the just-described spring seat design, which is characteristic of EMD-type injectors, the least thick cross-section of metal in the bending stress zone, when the spring seat is viewed in cross-section taken through its central axis, is the relatively small thickness of metal extending between the first and second annular junctures 27 and 29.

Such small thickness of metal is accordingly the locus of the greatest bending stresses. Substantially no bending stresses are carried by the portion of the spring seat head 25 that is below or distal to the second annular juncture 29, since that portion of the spring seat head is not tied to the nozzle valve extension 23, and is bypassed, so to speak, by the thrusting action of the extension 23.

As previously stated, in addition to depth of cross-section, another factor in the design of the spring seat is stress concentration at the metal surface at the inside corner formed by the intersection between the stem and the spring-receiving flat face of the spring seat, i.e., at the first juncture 27 in the illustrated conventional EMD-type injector. High surface stresses at this point can cause hairline faults, which then propagate to deeper points in the metal, leading to mechanical failure of the part. For EMD-type injectors, conventional practice has been to simply fillet this inside corner with a small radius, thereby reducing local stress concentration from what it would be at a sharply defined intersection, while at the same time avoiding any undercutting into the stem and consequent reduction of the already-small juncture-to-juncture distance referred to above. However, the smaller the corner radius, the higher the stress concentration in that corner. Spring seats of this design for EMD-type injectors have long operated successfully and with only occasional failures.

As also previously stated, for many other injector devices, including those disclosed in the patents cited above, in which the bending-stress zone below the spring-receiving annular face of a thrust-transmitting element extends more deeply below the spring-receiving face, avoidance of undercutting into the stem of the element has not been perceived as necessary, and in those devices, undercutting has been employed to provide larger radius curved-wall grooves in the stem instead of using filleting.

According to the present invention, undercutting may be removed as a concern for EMD-type injectors, and undercutting rather than filleting may be employed between the stem and the spring-receiving flat face of the spring seat of EMD-type injectors, provided the groove formed by the undercutting is properly shaped. The advantages of undercutting as a means of reducing stress concentration thereby become available in the design of EMD-type injector devices.

Figure 3:
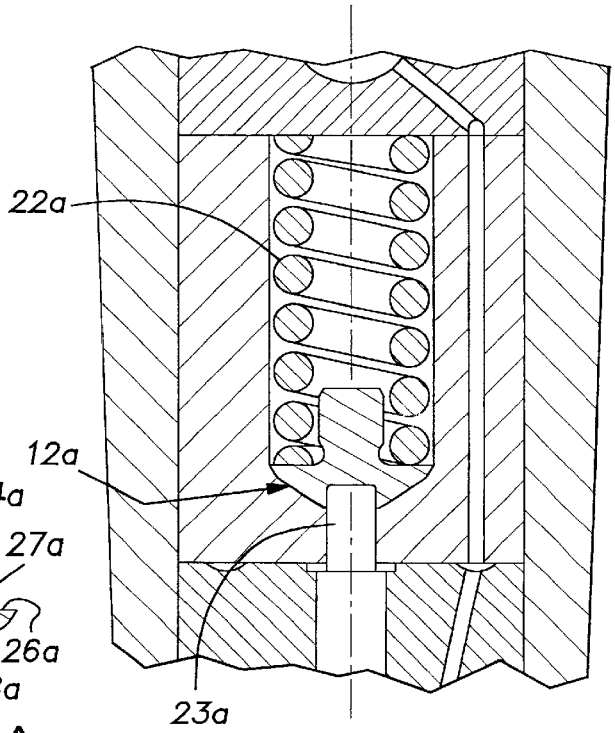
FIG. 3 is a fragmentary cross-sectional view on the same scale as FIG. 2 showing the spring cage and related elements in an embodiment of the invention.
Figure 3A:
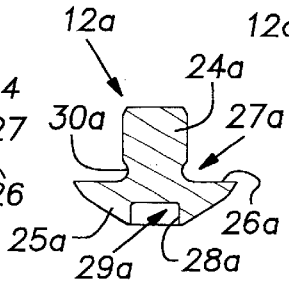
FIG. 3A is a cross-sectional view separately showing the spring seat seen in FIG. 3.

FIGS. 3 and 3A illustrate a spring seat for an EMD-type injector that embodies the invention and the proper shaping just referred to. In the illustrated device, the spring seat 12 is replaced by a spring seat 12*a* that provides undercutting to a given depth in the form of an annular groove 30*a*. The depth of undercutting is the depth of the groove's deepest penetration "below" the cylindrical surface of the stem 24*a* and radially into the stem. The depth of undercutting is preferably at least about 10 percent of the radius of the stem 24*a*. The groove 30*a* is preferably wider than it is deep, as shown.

At its lower edge, the groove 30*a* (FIG. 3A) is smoothly blended with the annular flat face 26*a* of the spring seat. Viewed in cross-section, as in the drawings, the wall of the groove begins to rise from the annular flat face 26*a* in the region of an imaginary projection of the cylindrical sidewall of the stem 24*a* onto the plane of the flat face 26*a*. The groove wall continues to rise to and past vertical and then returns radially outwardly to meet the cylindrical sidewall of the stem. This return is shown as arcuate in FIGS. 3 and 3A; however the return may be a straight, outward taper from the point where the groove wall passes vertical (or from a point slightly above such latter point) to where the groove wall meets the cylindrical sidewall of the stem 24*a*. At each point in the groove wall's aforesaid rise to vertical, the radius of curvature of the groove wall amounts to at least half the aforesaid depth of undercutting. At points in the groove wall's rise after the wall has passed vertical, the wall may also have radii of curvature that are at least half the depth of undercutting, although this may not be true at all such points.

Most simply, the groove wall may be a constant-radius arc whose radius equals the depth of undercutting, the latter being at least about ten percent of the radius of the spring seat stem. Such a constant-radius groove is within the shape parameters of the invention as set forth above, as is a groove where the radius of curvature of the groove wall varies between several or many different values within such parameters.

An example of such variance is: A groove which is shaped in cross-section as predominately an arc of constant radius, such constant radius being greater than the depth of undercutting. A groove of such shape will necessarily require the use of a radius of curvature that is reduced from such constant radius at the "beginning" portion of the arc where the wall begins to rise from the flat face of the spring seat. According to the present invention, such reduced radius of curvature should amount to at least half the depth of undercutting, in that sense putting a bottom limit on the degree to which the radius of curvature is reduced at such "beginning portion" of the arc.

Figure 2:
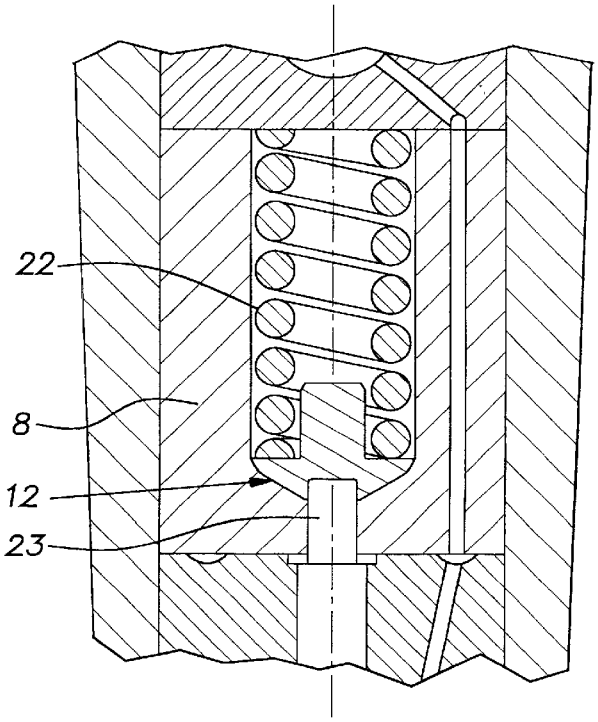
FIG. 2 PRIOR ART
FIG. 2 is a fragmentary cross-sectional view on an enlarged scale of the spring cage and related elements of the injector of FIG. 1.

All injector elements other than the spring seat 12*a* in the embodiment of FIG. 3 may be identical to corresponding elements seen in FIGS. 1 and 2. These include the spring 22*a*, the nozzle valve extension 23*a*, and other elements illustrated in FIG. 3.

Figure 2A:
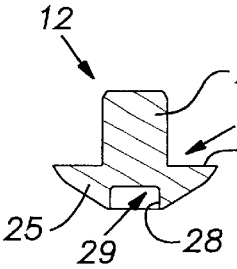
FIG. 2A PRIOR ART
FIG. 2A is a cross-sectional view separately showing the spring seat seen in FIG. 2.

In FIGS. 3 and 3*a*, the central head recess 28*a* receives the above-mentioned extension 23*a* of the associated nozzle valve, just as in FIGS. 2 and 2A the central head recess 28 receives the extension 23 of the nozzle valve 11. As is true of the interaction between corresponding elements in the prior-art device shown in FIGS. 1, 2 and 2A, in the device of FIGS. 3 and 3A any and all compressive or thrusting forces between the spring 22*a* and the nozzle valve are transmitted via a thrusting action imposed on the nozzle valve extension 23*a* in the up or down direction; all such forces are transmitted across the interface between the circular tip of the nozzle valve extension 23*a* and the circular end wall of the head recess 28*a*; and all such forces are transmitted between the spring 22*a* and the end wall of the head recess 28*a* through the body of the spring seat 12*a*. The compressive or thrusting forces between the spring 22*a* and the nozzle valve generate bending stresses in a bending stress zone in the body of the spring seat 12*a*, just as (as previously described) bending stresses are generated in a corresponding bending stress zone in the body of the spring seat 12 in the device of FIGS. 1, 2 and 2A.

Significantly, in the spring seat design contemplated by the invention, which is shown in FIGS. 3 and 3A and shaped as described above, the least thick cross-section of metal in the bending stress zone, when the spring seat is viewed in cross-section taken through its central axis, is the relatively small thickness of metal extending between the first and second annular junctures 27*a* and 29*a*, just as the least thick cross-section of metal in the bending stress zone in the device of FIGS. 1, 2 and 2A is the small thickness of metal extending between the first and second annular junctures 27 and 29. The distal end of the spring seat 12*a* at its foreshortened annular head 25*a* is free of direct connection with extension 23*a* of its associated nozzle valve and is unconnected with or free of all injector elements below itself, and is therefore essentially free of bending stresses, just as in the conventional device shown in FIGS. 1, 2 and 2A, the distal end of the spring seat 12 at its foreshortened annular head 25 is free of direct connection with extension 23 of its associated nozzle valve and is unconnected with or free of all injector elements below itself, and is therefore essentially free of bending stresses.

Again, in the device shown in FIGS. 3 and 3A, and as characteristic of EMD-type injectors, such small thickness of metal is accordingly the locus of the greatest bending stresses. Substantially no bending stresses are carried by the portion of the spring seat head 25*a* that is below or distal to the second annular juncture 29*a*, since that portion of the spring seat head is not tied to the nozzle valve extension 23*a*, and is bypassed, so to speak, by the thrusting action of the extension 23*a*.

Even though the foregoing is true, providing a EMD-type injector spring seat with an undercut groove shaped as described above reduces the incidence of mechanical failure as compared with a conventionally filleted EMD-type injector spring seat. This is so even though the presence of such groove slightly reduces the juncture-to-juncture distance referred to above. That is, the rate of mechanical failure is reduced even though, all other things being equal, the juncture-to-juncture distance between first and second annular junctures 27*a* and 29*a* of the spring seat 12*a* is slightly less than the juncture-to-juncture distance between first and second annular junctures 27 and 29 of the conventional spring seat 12. The rate of mechanical failure is reduced even though the bending stress zone of the spring seat 12*a* is slightly narrower than that of a spring seat of conventional design for an EMD-type injector, such as the spring seat 12.

Public sensitivity to environmental concerns, and government regulation relating to such concerns, puts continuing political and regulatory pressures on diesel engine operators and designers to reduce levels of nitrous oxides, hydrocarbons and smoke in exhaust emissions. These political and regulatory pressures stimulate not only development of new designs of diesel devices, but also improvements of standard products already in wide use, such as EMD-type fuel injectors, to preclude premature failure, that is, to keep the equipment working properly up to the time of scheduled service periods.

One factor generally favoring improved emissions in existing types of mechanical injectors is the increasing of injection operating pressures. In a mechanical injection device, all else being equal, increased nozzle valve opening pressure and higher valve lift with increased horsepower engines result in higher mechanical stresses and will at some point cause "weakest link" mechanical failure. One such "weakest link" point of failure in EMD-type injectors has been found to be the spring seat. The present invention, in reducing mechanical failure rates for this element, opens the way to further improved long term emissions performance for this standard and widely used type of mechanical injector.

What is claimed is:

1. In an EMD-type injector having a plunger and bushing assembly to meter and deliver fuel, a check valve cage and check valve for preventing reverse flow of the fuel, a spring cage, a coil spring and an annular spring seat within the spring cage, an injection nozzle body, a housing-nut surrounding said plunger and bushing assembly, check valve cage, spring cage and injection nozzle body, said housing nut threadedly clamping said elements together in stacked relationship, the spring seat having a foreshortened annular head that is axially shorter than it is wide, the spring seat also having a spring seat stem coaxial with the head, the spring seat stem being received within and surrounded by the lower end of the coil spring, the diameter of the spring seat stem sidewall being smaller than that of the diameter of the spring seat head but sufficient that the coil spring is relatively closely radially spaced from the spring seat stem sidewall, the spring seat having an annular flat face formed on the proximal side of its head, the lower or distal end of the coil spring bearing on said annular flat face, the end of said coil spring being ground flat to provide area contact between said spring and said flat face around a majority of the annular extent of said flat face, the coil spring being unrestricted against rotating around its central axis as it compresses and expands, said annular flat face being perpendicular to said stem sidewall and meeting it at a first annular juncture, an axially central head recess extending axially within the foreshortened annular head from the distal end of the spring seat, said recess having an annular sidewall and terminating in a circular end wall perpendicular to the sidewall of the recess and meeting said sidewall at a second annular juncture, the diameter of said central head recess being smaller than the diameter of said spring seat stem, a nozzle valve slidable in said nozzle body and being openable under pressure of incoming fuel and closeable under pressure of the coil spring when said fuel pressure decreases, the proximal end of said nozzle valve comprising a valve extension, said valve extension being received in said head recess of the spring seat to act with the spring seat to transmit mechanical compressive forces between the nozzle valve and the coil spring, said forces generating bending stresses in a bending stress zone in the body of the spring seat, said distal end of said spring seat at said foreshortened annular head thereof being essentially unconnected with or free of all elements below it and therefore being outside said bending stress zone, the least thick cross-section of metal in said bending stress zone, when the spring seat is viewed in cross-section taken through its central axis, being the thickness of metal extending between said first and second annular junctures, the improvement wherein, in the said EMD-type injector, the said first annular juncture of the spring seat is formed by an annular groove undercut in the spring seat stem to a given depth of undercutting, said groove being smoothly blended at said groove's lower edge with said annular flat face of the spring seat, the wall of said groove beginning to rise from said annular flat face in the region of an imaginary projection of the cylindrical sidewall of said stem onto the plane of said flat face, said groove wall continuing to rise to and past vertical and then returning radially outwardly to meet the cylindrical sidewall of the stem, the radius of curvature of said groove wall, at each point in said groove wall's rise to vertical, amounting to at least half the aforesaid depth of undercutting, said provision of said groove reducing mechanical failures from what they are without said provision even though said provision slightly reduces said least thick cross-section of metal in said bending zone from what it would be without provision of said groove.

2. A device as in claim 1, said groove being wider than it is deep.

3. A device as in claim 2, said aforesaid depth of undercutting being at least about ten percent of the radius of said spring seat stem.

4. A device as in claim 3, said groove in cross-section comprising a constant-radius arc whose radius equals the aforesaid depth of undercutting.

* * * * *